US007625243B2

(12) United States Patent
Chen et al.

(10) Patent No.: US 7,625,243 B2
(45) Date of Patent: Dec. 1, 2009

(54) EXTENSION TO VERSION 2.0 UNIVERSAL SERIAL BUS CONNECTOR WITH IMPROVED CONTACT ARRANGEMENT

(75) Inventors: Kuan-Yu Chen, Harrisburg, PA (US); Chong Yi, Mechanicsburg, PA (US); James M. Sabo, Harrisburg, PA (US); Joseph Ortega, Camp Hill, PA (US); Gary E. Biddle, Carlisle, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/818,100

(22) Filed: Jun. 13, 2007

(65) Prior Publication Data

US 2008/0311801 A1 Dec. 18, 2008

(51) Int. Cl.
*H01R 24/00* (2006.01)

(52) U.S. Cl. ..... 439/660; 439/924.1; 439/541.5; 439/607.01; 439/607.23

(58) Field of Classification Search ..... 439/660, 439/607, 609, 541.5, 924.1, 607.01, 607.23, 439/638, 686
See application file for complete search history.

(56) References Cited

U.S. PATENT DOCUMENTS

| | | | | |
|---|---|---|---|---|
| 5,564,949 | A * | 10/1996 | Wellinsky | 439/607 |
| 6,238,244 | B1 * | 5/2001 | Yang | 439/607 |
| 6,270,379 | B1 * | 8/2001 | Huang et al. | 439/660 |
| 7,104,848 | B1 * | 9/2006 | Chou et al. | 439/660 |
| 7,128,617 | B2 * | 10/2006 | Wang et al. | 439/660 |
| 7,232,346 | B2 * | 6/2007 | Hu et al. | 439/660 |
| 7,422,488 | B1 * | 9/2008 | Wu | 439/676 |

* cited by examiner

*Primary Examiner*—Xuong M Chung-Trans
(74) *Attorney, Agent, or Firm*—Wei Te Chung; Andrew C. Cheng; Ming Chieh Chang

(57) ABSTRACT

An extension to USB includes an insulative tongue portion and a number of contacts held in the insulative tongue portion. The contacts have four conductive contacts and a plurality of differential contacts for transferring differential signals located behind/forward the four standard USB contacts along a front-to-rear direction. The four conductive contacts are adapted for USB 2.0 protocol and the plurality of differential contacts are adapted for non-USB 2.0 protocol. The extension to USB is capable of mating with a complementary standard USB 2.0 connector and a non-USB 2.0 connector, alternatively.

8 Claims, 15 Drawing Sheets

EXTENSION TO VERSION 2.0 UNIVERSAL SERIAL BUS CONNECTOR WITH IMPROVED CONTACT ARRANGEMENT

BACKGROUND OF THE INVENTION

1. Field of the Invention

The present invention relates to electrical connectors, more particularly to electrical connectors compatible to standard Universal Serial Bus (USB) connectors.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

FIGS. 14 and 15 show existing USB connectors. In FIG. 14, this USB connector 500 is an existing USB plug, male connector. In application, the USB plug 500 may be mounted on a board in the peripherals, or may be connected to wires of a cable 57 as shown in FIG. 14. Generally, an insulative outer housing 55 always be molded over a rear end of the USB plug 500 and the cable 57 to secure the USB plug 500, the cable 57 and the insulative outer housing 55 together. The USB plug 500 can also be mounted in an opening in a plastic case of a peripheral, like a portable memory device. The USB plug 500 represents a type-A USB connector. The USB plug 500 includes an insulative plug tongue portion 52 formed of an insulating material, four conductive contacts 53 held on the insulative plug tongue portion 52 and an metal shell 54 enclosing the conductive contacts 53 and the insulative plug tongue portion 52. The metal shell 54 touches the insulative plug tongue portion 52 on three of the sides of the plug tongue portion 52 except a top side thereof. The conductive contacts 53 are supported on the top side of the plug tongue portion 52. A receiving cavity 56 is formed between the top side of the plug tongue portion 52 and a top face 541 of the metal shell 54 for receiving a corresponding insulative receptacle tongue portion 62 shown in FIG. 15. The conductive contacts 53 carry the USB signals generated or received by a controller chip in the peripherals.

USB signals typically include power, ground (GND), and serial differential data D+, D−. To facilitate discussion, the four conductive contacts 53 of the USB plug 500 are designated with numeral 531, 532, 533 and 534 in turn as shown in FIG. 14. In application, the four conductive contacts 531, 532, 533 and 534 are used to transfer power, D−, D+ and ground signals, respectively. The two central conductive contacts 532, 533 are used to transfer/receive data to/from the peripheral device or a host device. The four conductive contacts 531, 532, 533 and 534 can be formed of metal sheet in a manner being stamped out therefrom to four separated ones or formed as conductive pads on a printed circuit board (not shown) supported on the top side of the plug tongue portion 52.

FIG. 15 shows an existing USB receptacle 600, a female USB connector for mating with the existing USB plug 500. The USB receptacle 600 commonly is an integral part of a host or PC. The USB receptacle 600 also presents a type-A USB connector. The USB receptacle 600 includes the insulative receptacle tongue portion 62 formed of an insulating material, four conductive contacts 63 held on the insulative receptacle tongue portion 62 and a metal shell 64 shielding the conductive contacts 63 and the insulative receptacle tongue portion 62. The conductive contacts 63 are supported on a bottom surface of the insulative receptacle tongue portion 62. Same to assignment of the four conductive contacts 53 of the USB plug 500, assignment of the four conductive contacts 63 of the USB receptacle 600 is contact 631 for power signal, contact 632 for D− signal, contact 633 for D+ signal and contact 634 for GND. Another receiving cavity 66 is formed between the bottom surface of the insulative receptacle tongue portion 62 and a bottom of the metal shell 64. In application, the USB plug 500 usually disposed in the peripheral device is inserted into the USB receptacle 600 mounted in the host or PC device. The plug tongue portion 52 is received in the receiving cavity 66 of the USB receptacle 600 and the receptacle tongue portion 62 is received in the receiving cavity 56 of the USB plug 500. After full insertion of the USB plug 500, the conductive contacts 531, 532, 533 and 534 of the USB plug 500 make a physical and electrical connection with the conductive contacts 631, 632, 633 and 634 of the USB receptacle 600, respectively, to transmit/receive signal to/from the host device to the peripheral device.

As discussed above, the existing USB connectors have a small size but low transmission rate, while other non-USB connectors (PCI Express, SATA, et al) have a high transmission rate but large size. Neither of them is desirable to implement modern high-speed, miniaturized electronic devices and peripherals. To provide a kind of connector with a small size and a high transmission rate for portability and high data transmitting efficiency is much desirable. Such kind electrical connectors are disclosed in a U.S. Pat. No. 7,021,971 (hereinafter 971 patent) issued on Apr. 4, 2006. Detailed description about these connectors is made below.

From the FIGS. 4A-6H and detailed description of 971 patent, we can find that the invention material of 971 patent is to extend the length of the plug and receptacle tongue portions of the existing USB connectors and to extend depth of the receiving cavity of the existing USB connectors, thereby to accommodate additional contacts in extended areas as shown in FIGS. 4A-5H of 971 patent; or to provide the additional contacts on a reverse-side of the plug tongue portion and accordingly with regard to receptacle, to provide a lower tongue portion under a top receptacle tongue portion thereby four USB contacts are held on the top tongue portion and additional contacts are accommodated on the lower tongue portion of the receptacle. With contrast with existing USB type-A receptacle, the receptacle with top and lower tongue portion is higher in height than existing USB receptacle.

As shown in FIGS. 4C, 4D, 5C, 5D and 6C, 6D of the 971 patent, number of the additional contacts is eight. The eight additional contacts plus the four USB contacts are used collectively or in-collectively for PCI-Express, SATA or IEEE 1394 protocol as required. To make the extended-USB plug and receptacle capable of transmitting PCI-Express or SATA or IEEE 1394 signals is the main object of the 971 patent. To achieve this object, at least eight contacts need to be added. Adding eight contacts in existing USB connector is not easy. May be, only embodiments shown in 971 patent are viable options to add so many contacts. As fully discussed above, the receptacle equipped with two tongue portions or plug and receptacle both with a longer length are also clumsiness. That is not very perfect from a portable and small size standpoint.

BRIEF SUMMARY OF THE INVENTION

An extension to USB connectors include an extension to USB plug and an extension to USB receptacle. The extension to USB plug comprises an elongate insulative plug tongue portion extending in a front-to-rear direction and defining a supporting surface, and a plurality of contacts held in the supporting surface. The plurality of contacts comprise four conductive plug contacts and a plurality of additional contacts. The four plug conductive contacts consist of a power contact, a ground contact, a – data contact and a + data contact. An arrangement of the four plug conductive contacts is compatible to a standard USB receptacle. The plurality of additional contacts comprise at least one pair of differential plug contacts for transferring/receiving high-speed signals. Each of the four plug conductive contacts and each of the additional contacts comprise a nonelastic contact portion and an elastic contact portion, respectively. The elastic contact portion of each differential contact is located behind the nonelastic contact portion of each conductive contact along the front-to-rear direction. The plurality of additional contacts are adapted for non-USB protocol.

The extension to USB receptacle comprises an elongate insulative receptacle tongue portion extending in a front-to-rear direction and defining a supporting surface, and a plurality of contacts held in the supporting surface. The plurality of contacts comprise four receptacle conductive contacts and a plurality of additional contacts. The four receptacle conductive contacts consist of a power contact, a ground contact, a – data contact and a + data contact. An arrangement of the four receptacle conductive contacts is compatible to a standard USB plug. The plurality of additional contacts comprise at least one pair of differential receptacle contacts for transferring/receiving high-speed signals corresponding to said differential plug contacts of the extension to USB plug. Each of the four receptacle conductive contacts and each of the additional contacts comprise an elastic contact portion and a nonelastic contact portion, respectively. The nonelastic contact portion of each differential contact is located forward the elastic contact portion of each conductive contact along the front-to-rear direction. The plurality of additional contacts are adapted for non-USB protocol. With such arrangement, the extension to USB connectors are with ease structures and are portable. Furthermore, as the conductive contacts are used for USB protocol and the additional contacts are used for non-USB protocol, now, the extension to USB plug can be applied in electronic devices either supporting the USB protocol or the non-USB protocol.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
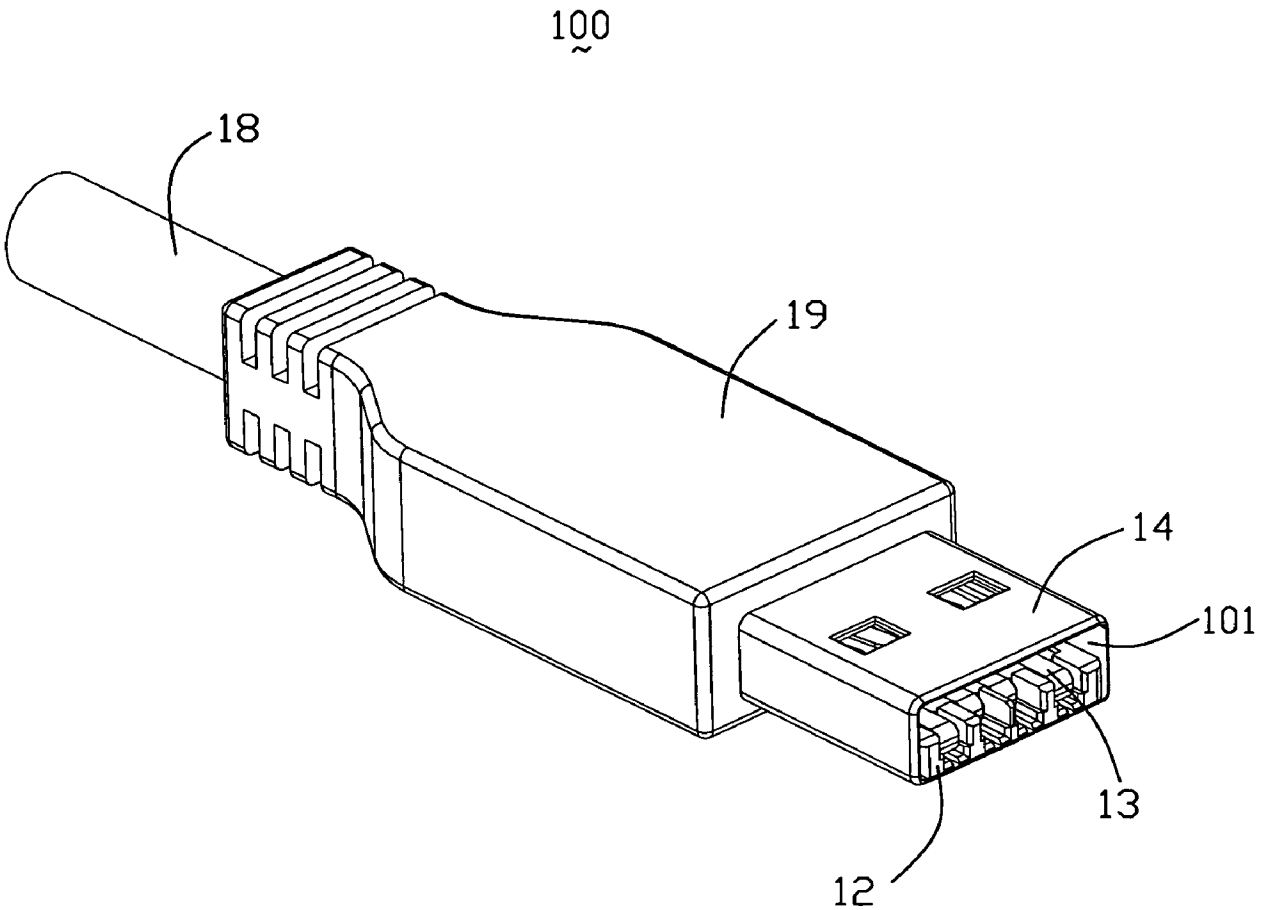
FIG. 1 is a perspective view of an extension to USB plug according to a first embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB connector, receptacle, plug, and signaling all refer to the USB architecture described within the Universal Serial Bus Specification, 2.0 Final Draft Revision, Copyright December, 2002, which is hereby incorporated by reference herein. USB is a cable bus that supports data exchange between a host and a wide range of simultaneously accessible peripherals. The bus allows peripherals to be attached, configured, used, and detached while the host and other peripherals are in operation. This is referred to as hot plugged.

Referring to FIGS. 1-5, an extension to USB plug 100 according to a first embodiment of the present invention is disclosed. The extension to USB plug 100 includes an insulative base portion 11, an insulative tongue portion 12 extending from the insulative base portion 11 in a front-to-rear direction, a plurality of contacts 13 supported in the insulative tongue portion 12 and a metal shell 14 enclosing the insulative tongue portion 12 and the contacts 13. Besides, a cable 18 is disposed to electrically connect with the contacts 13. In order to provide a strong structure of the extension to USB plug 100, an outer insulative housing 19 is over molded on a rear section of the base portion 11 together with the metal shell 14 and the cable 18. The outer insulative housing 19 is adapted for grasping by a user when the extension to USB plug 100 is used. In below description of an extension to USB receptacle 200 (shown in FIGS. 6-9), same terminologies are adopted to similar elements, the extension to USB receptacle 200 also includes an insulative base portion 21, an insulative tongue portion 22 extending forwardly from the insulative base portion 21 in the front-to-rear direction, a plurality of contacts 23 held in the insulative tongue portion 22 and a metal shell 24 enclosing the insulative base portion 21 together with the insulative tongue portion 22 and the contacts 23. To facilitate description on them, we further name these elements of the plug 100 as plug base portion 11, plug tongue portion 12, plug contacts 13, plug metal shell 14; we also further name these elements of the receptacle 200 as receptacle base portion 21, receptacle tongue portion 22, receptacle contacts 23, receptacle metal shell 24. Detail description of these elements and their relationship and other elements formed thereon will be detailed below.

Referring to FIGS. 1-5, in this embodiment of the present invention, the plug base portion 11 and the plug tongue portion 12 are integrally injecting molded as an unit one piece, named as a plug housing 10. The plug tongue portion 12 defines a supporting surface 121 on a top level and a bottom surface 122 opposite to the supporting surface 121. The plug base portion 11 and the plug tongue portion 12 define a front end 110, 120 and a rear end 112, 126 opposite to their front ends 110, 120, respectively. The plug tongue portion 12 extends forwardly from the front end 110 of the plug base portion 11 along the front-to-rear direction. In other words, the rear end 126 of the plug tongue portion 12 connects with the front end 110 of the plug base portion 11. The plug base portion 11 forms a plurality of projections 113 on lateral sides thereof for engaging with the plug metal shell 14. A plurality of depressed portions 114 are recessed on a top side of the plug base portion 11 for engagement with corresponding projections formed on the plug metal shell 14. A plurality of plug contact receiving passageways 123 are recessed in the supporting surface 121 of the plug tongue portion 12.

In this embodiment of the present invention, the plug contacts 13 include four plug conductive contacts designated with numeral 131, 132, 133 and 134 and a plurality of additional plug contacts 137. The passageways 123 for receiving the four conductive contacts 131, 132, 133 and 134 are recessed from the front end 120 of the plug tongue portion 12 and extend backwardly along the front-to-rear direction. The passageways 123 for receiving the additional plug contacts 137 are located behind the passageways 123 for receiving the four plug conductive contacts 131, 132, 133 and 134 along the front-to-rear direction. The four plug conductive contacts 131, 132, 133 and 134 are inserted into corresponding passageways 123 from the front end 120 of the plug tongue portion 12 while the additional plug contacts 137 are inserted into corresponding passageways 123 from the rear end 112 of the plug base portion 11. The plurality of additional plug contacts 137 are located behind the conductive contacts 131, 132, 133 and 134 without disturbing any one of the conductive contacts 131, 132, 133 and 134.

Figure 2:
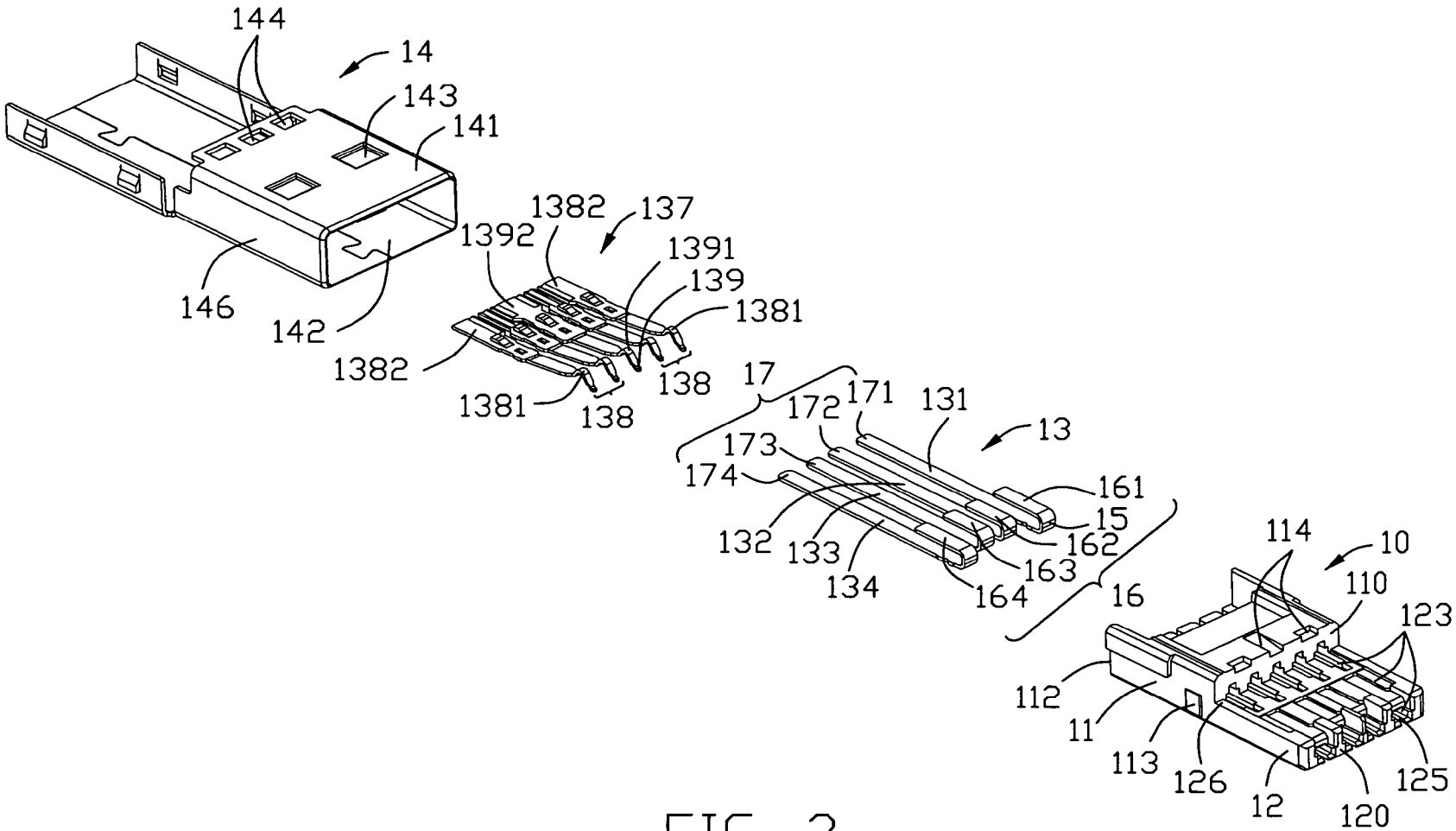
FIG. 2 is an exploded perspective view of the extension to USB plug shown in FIG. 1 with an insulative outer housing and a cable thereof removed therefrom.
Figure 3:
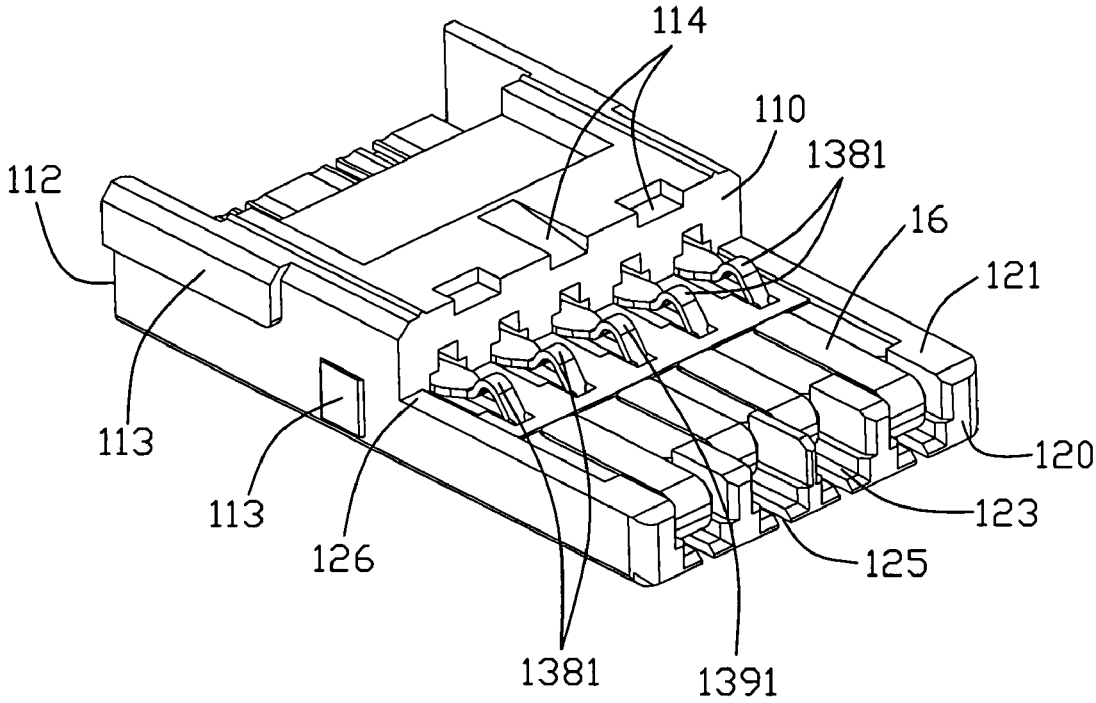
FIG. 3 is a perspective view of the extension to USB plug shown in FIG. 2 with a metal shell thereof removed therefrom.
Figure 4:
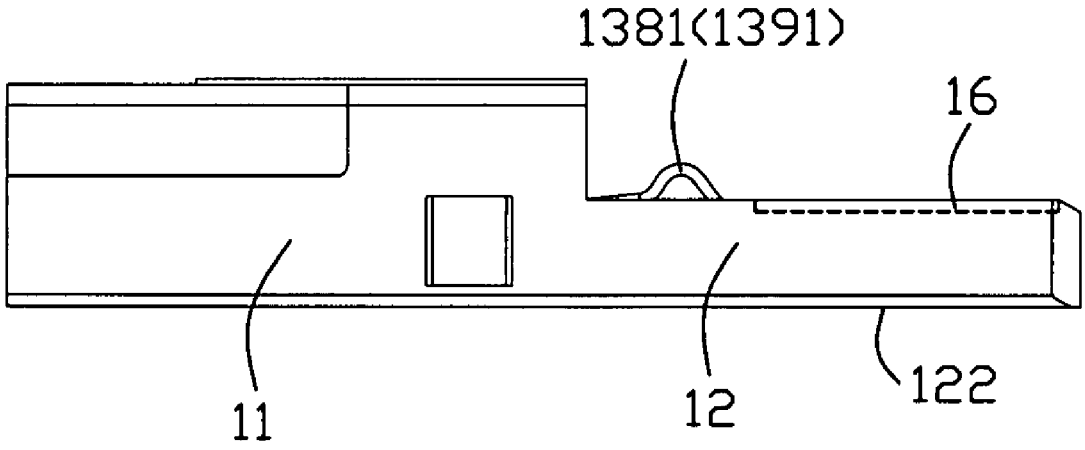
FIG. 4 is a side view of the extension to USB plug shown in FIG. 3.
Figure 5:
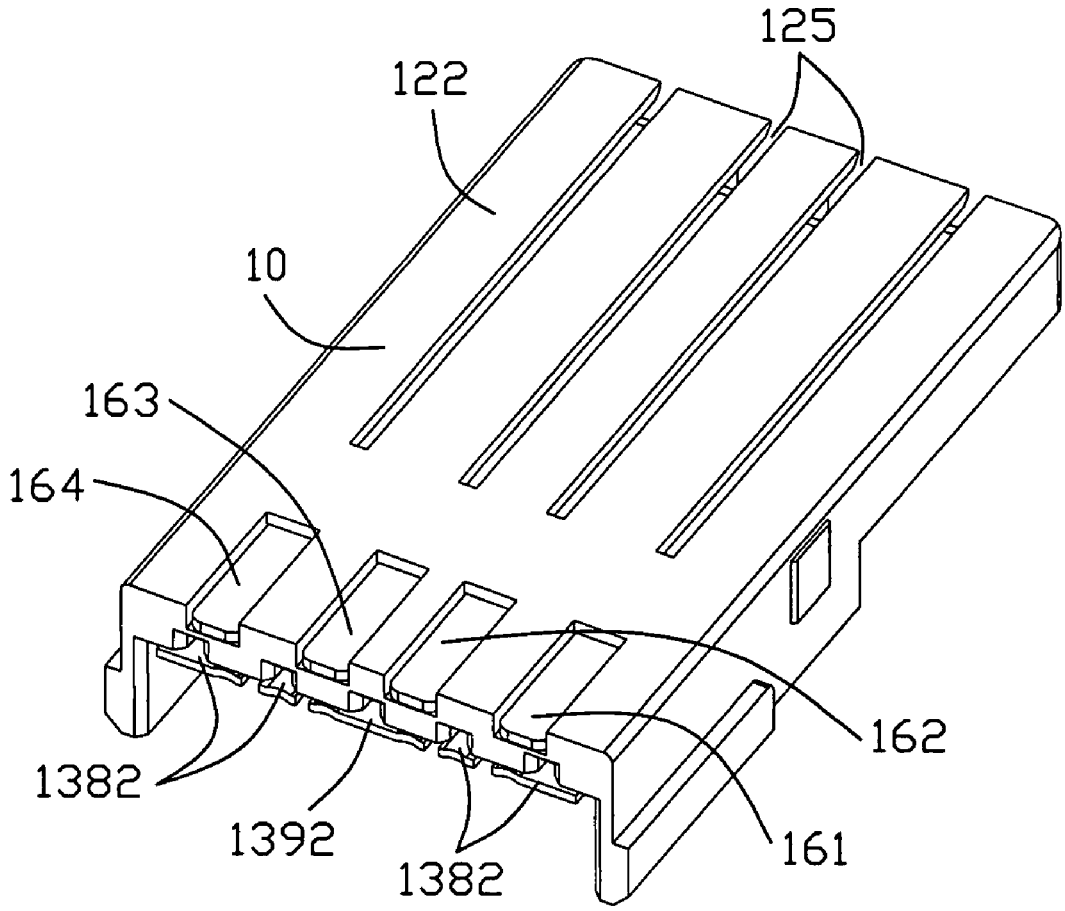
FIG. 5 is a view similar to FIG. 3, but taken from another aspect.

As shown in FIG. 2, the conductive contacts 131, 132, 133 and 134 are substantially of the same configuration and each comprises a plug contact portion 16 and a tail portion 17 under the plug contact portion 16. The conductive contacts 131, 132, 133 and 134 are juxtaposed with respect to each other along the front-to-rear direction when they are received in corresponding passageways 123. Each tail portion 17 is adapted for connecting with the cable 18. The plug contact portion 16 is flat and nonelastic. When the four conductive contacts 131, 132, 133 and 134 are inserted into corresponding passageways 123, each plug contact portion 16 thereof is substantially coplanar with the supporting surface 121 as shown in FIGS. 3-4. Besides, each conductive contact 131, 132, 133 and 134 comprise a bridge 15 with the plug contact portion 16 and the tail portion 17 respectively extending from upper and lower edges thereof and extending backwardly along the front-to-rear direction. The plug contact portion 16 and the tail portion 17 are parallel to each other wherein the plug contact portion 16 is much shorter than the tail portion 17. The plug contact portions 16 of the four plug conductive contacts 131, 132, 133 and 134 are designated respectively with numeral 161, 162, 163 and 164. Also, the tail portions 17 of the four plug conductive contacts 131, 132, 133 and 134 are designated respectively with numeral 171, 172, 173 and 174 as clearly shown in FIG. 2. The bottom surface 122 of the plug tongue portion 12 further defines a plurality of lengthwise slots 125 extending along the front-to-rear direction, as shown in FIG. 5. The slots 125 extend from the front end 120 to the plug base portion 11 and communicate with corresponding receiving passageways 123 for easily receiving the tail portions 171, 172, 173 and 174.

As shown in FIG. 2, in this embodiment, the additional plug contacts 137 include two pairs of differential plug contacts 138 and a grounding plug contact 139. The two pairs of differential plug contacts 138 are used for transferring/receiving high-speed signals, and the grounding plug contact 139 is disposed between the two pairs of differential plug contacts 138 for preventing cross-talk. Each differential plug contact 138 of each pair comprises an elastic contact portion 1381 and a tail portion 1382 opposite to the contact portion 1381. When the additional plug contacts 137 are inserted into corresponding passageways 123, the differential plug contacts 138 and the grounding plug contact 139 are juxtaposed with respect to each other along the front-to-rear direction. The grounding plug contact 139 comprises an elastic grounding contact portion 1391 which is of the same configuration as the contact portion 1381, and a grounding tail portion 1392 located between the tail portions 1382 of each pair. The plug contact portions 161, 162, 163 and 164 of the four plug conductive contacts 131, 132, 133 and 134 occupy a majority of length of the plug tongue portion 12 along the front-to-rear direction with respect to what of the contact portions 1381, 1391 of the additional plug contacts 137 as shown in FIGS. 3-4. All the tail portions 1382, 1392 electrically connect with the cable 18. Meanwhile, the tail portions 1382, 1392 are offset from the tail portions 17 of the conductive contacts 131, 132, 133 and 134 in a height direction perpendicular to the front-to-rear direction. The tail portions 1382, 1392 are located under the tail portions 17 of the conductive contacts 131, 132, 133 and 134 to prevent electrical shorting. Besides, each contact portion 1381, 1391 is cantileveredly received in the passageways 123 and protruding upwardly beyond the supporting surface 121 so that the contact portion 1381, 1391 is elastic and deformable when engaging with corresponding contacts of the extension to USB receptacle 200. The plug contact portions 1381, 1382 and 16 are separated in the front-to-rear direction with no portion of them contacting each other.

Figure 15:
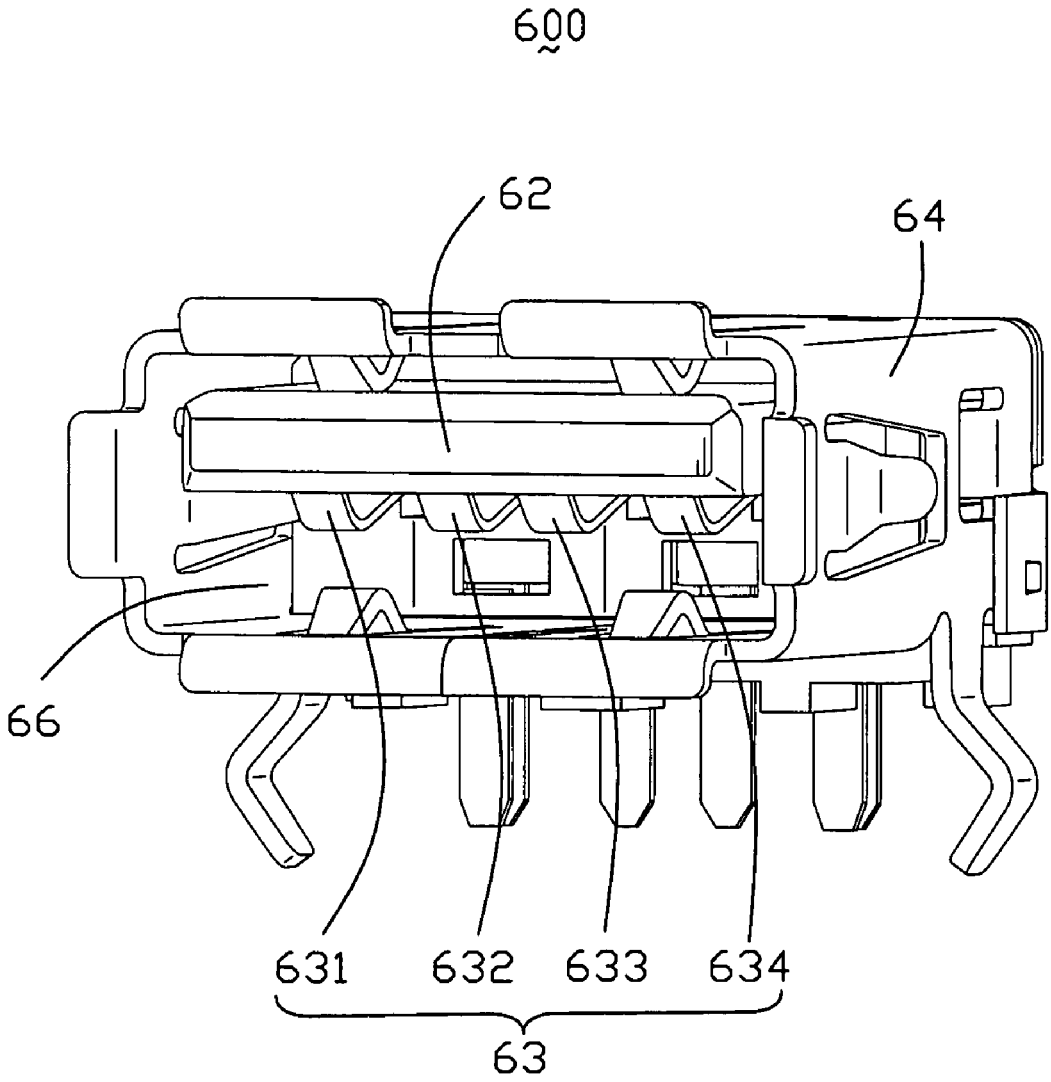
FIG. 15 (PRIOR ART)
FIG. 15 is a perspective view of an existing standard USB receptacle.

The extension to USB plug 100 is compatible to existing standard USB receptacle, such as the standard USB receptacle 600 shown in FIG. 15. The geometric profile of the plug tongue portion 12 is same to what of the standard USB plug 500 within an allowable tolerance. That is, length, width and height of the plug tongue portion 12 are substantially equal to what of the standard USB plug 500. An arrangement of the four plug conductive contacts 131, 132, 133 and 134 is compatible to what of the standard USB receptacle 600. The four plug conductive contacts 131, 132, 133 and 134 are for USB protocol to transmit USB signals. In detail, the four conductive contacts 131, 132, 133 and 134 are for power (VBUS) signal, – data signal, + data signal and grounding, respectively. So now, from assignment of each plug conductive contacts standpoint, different terminology are given to each of the four plug conductive contacts 131, 132, 133 and 134, wherein the conductive contacts 131, 132, 133 and 134 are respectively named as power contact 131, – data contact 132, + data contact 133 and ground contact 134.

Referring to FIGS. 1 and 2, the plug metal shell 14 is in a tube shape, which defines a top face 141, a bottom face 142 opposite to the top face 141 and a pair of sidewalls 146 connecting the top and bottom faces 141 and 142. The plug metal shell 14 is mounted to the plug base portion 11 to enclose the plug tongue portion 12 and the plug contacts 13 with a receiving cavity 101 formed between the supporting surface 121 and the top face 141. The plug metal shell 14 touches other three sides of the plug tongue portion 12 except the supporting surface 121. The plug contact portions 16 are all exposed to the receiving cavity 101 for mating with corresponding contact portions of a complementary connector. An arrangement of the plug metal shell 14 and the plug tongue portion 12 is also compatible with what of standard USB receptacle 600. Each of the top and bottom faces 141, 142 define a pair of through holes 143 for engagement with corresponding connectors. The top face 141 also forms a plurality of projections 144 in a shape of tab projecting inwardly to engage with depressed portions 114 of the plug base portion 11. The projections 113 formed on the plug base portion 11 abut against the sidewalls 146 of the plug metal shell 14. Thus, the plug metal shell 14 is secured on the plug base portion 11.

In the first embodiment, the plug contacts 13 are all formed of a metal sheet and separated form each other. It is also to be understood that, in other embodiments, the plug conductive contacts 131, 132, 133 and 134 can be conductive pads formed on a printed circuit board which is supported on the supporting surface 121 of the plug tongue portion 12. These two options to make contacts are both viable in current industry.

In FIG. 6-9, the extension to USB receptacle 200 is disclosed. In this embodiment, the extension to USB receptacle 200 is a stacked receptacle with two single receptacles, one located on the top and the other on the below. Of course, a single one interface is easy to make under a principle similar to the stacked one. Now, detailed description of the extension to USB receptacle 200 is made below. The extension to USB receptacle 200 includes a receptacle housing 20, the receptacle contacts 23 received in the receptacle housing 20, the receptacle metal shell 24 enclosing the receptacle housing 20, a rear metal shell 28 attached to a rear side of the receptacle housing 20 and another metal shell 29 enclosing a supporting plate 25 of the receptacle housing 20.

The receptacle housing 20 includes the receptacle base portion 21, a pair of the receptacle tongue portions 22 and the supporting plate 25. The receptacle base portion 21, the receptacle tongue portions 22 and the supporting plate 25 are integrally injecting molded as one piece of the receptacle housing 20. The supporting plate 25 is positioned between the pair of receptacle tongue portions 22. The receptacle tongue portion 22 defines a supporting surface 221 on a bottom level and a top surface 222 opposite to the supporting surface 221. The receptacle base portion 21 and tongue portion 22 define a front end 210, 220 and a rear end 212, 226 opposite to their front end 210, 220, respectively. The receptacle tongue portions 22 and the supporting plate 25 all extend forwardly in the front-to-rear direction from the front end 210 of the receptacle base portion 21. In other words, the rear end 226 of the receptacle tongue portion 22 connects with the front end 210 of the receptacle base portion 21. The receptacle base portion 21 forms a plurality of projections 213 on a pair of sidewalls 211 thereof and near the rear end 212. On a bottom side 215 of the receptacle base portion 21, a plurality of standoffs 216 protruding outwardly for standing on a board (not shown) that the extension to USB receptacle 200 is mounted on. A pair of depressed portions 214 are formed on the sidewalls 211 of the receptacle base portion 21 for engagement with corresponding projections formed on the receptacle metal shell 24. A plurality of receptacle contact receiving passageways 223 are recessed in the supporting surface 221 of the receptacle tongue portion 22 to receive the receptacle contacts 23. The receptacle contact receiving passageways 223 all extend from the receptacle tongue portion 22 towards the receptacle base portion 21. The receptacle base portion 21 defines a rear room 203 for receiving part of the receptacle contacts 23.

Figure 7:
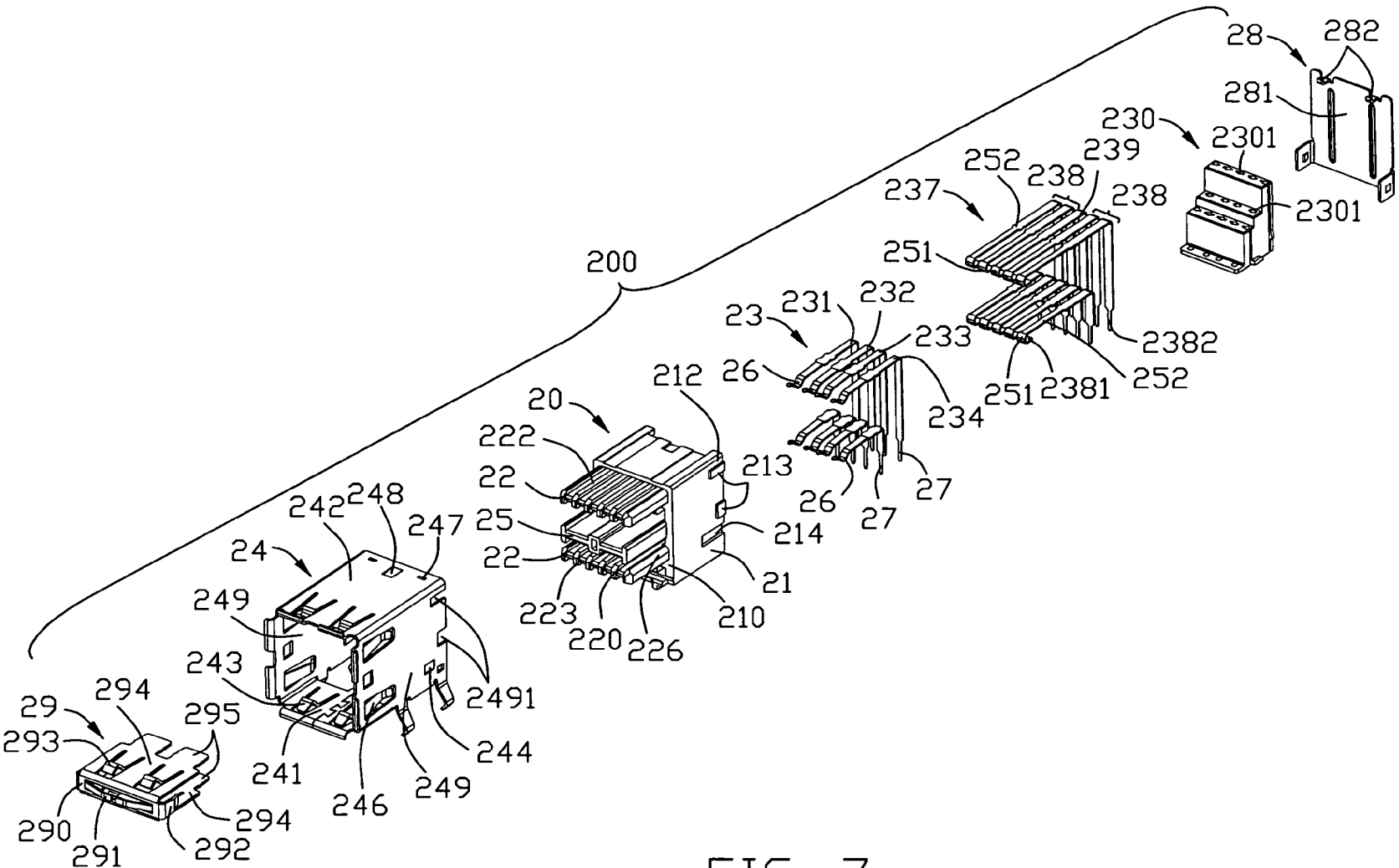
FIG. 7 is an exploded perspective view of the extension to USB receptacle shown in FIG. 6.
Figure 8:
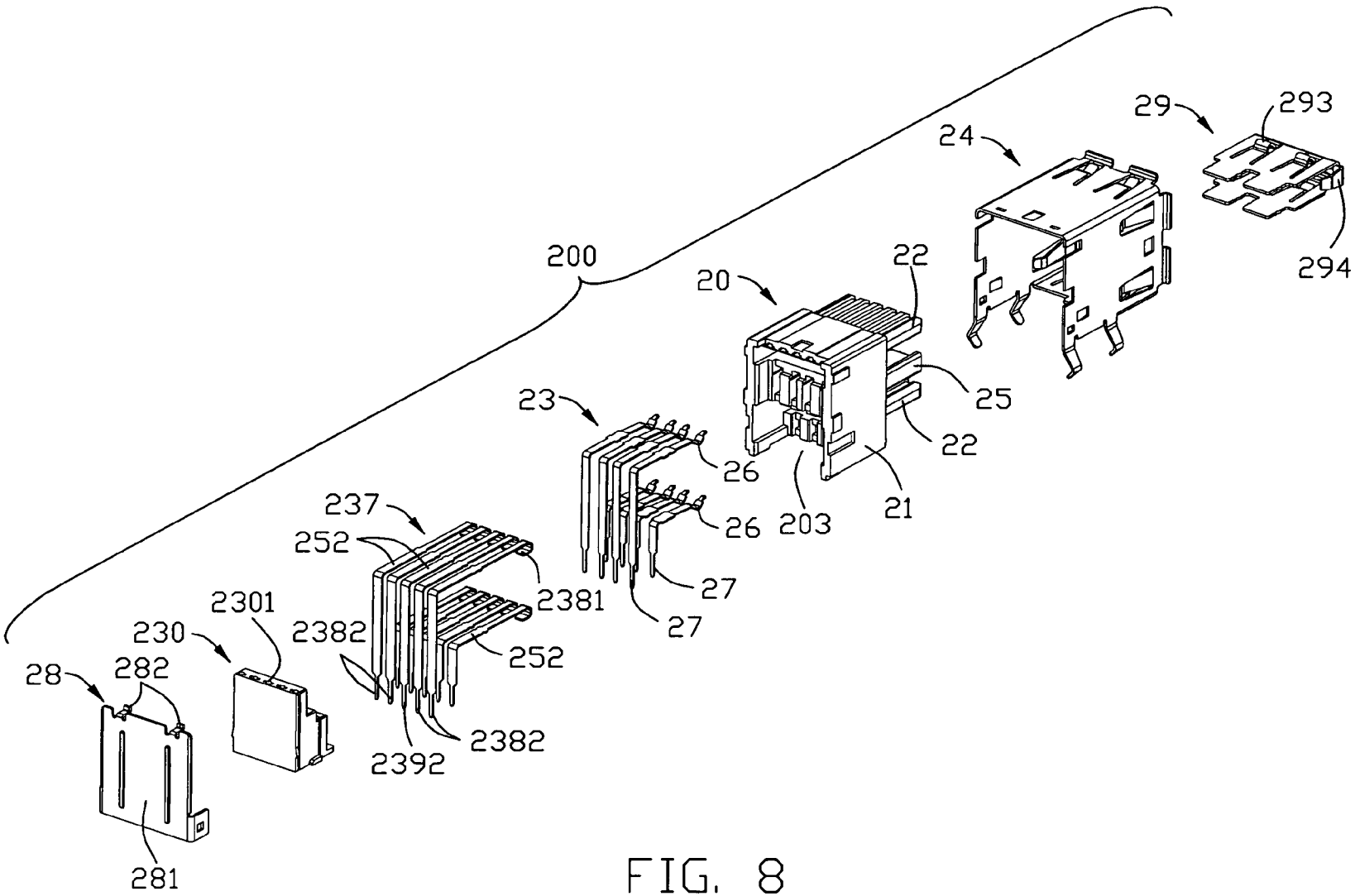
FIG. 8 is another exploded perspective view of the extension to USB receptacle shown in FIG. 6, while taken from another aspect.
Figure 9:
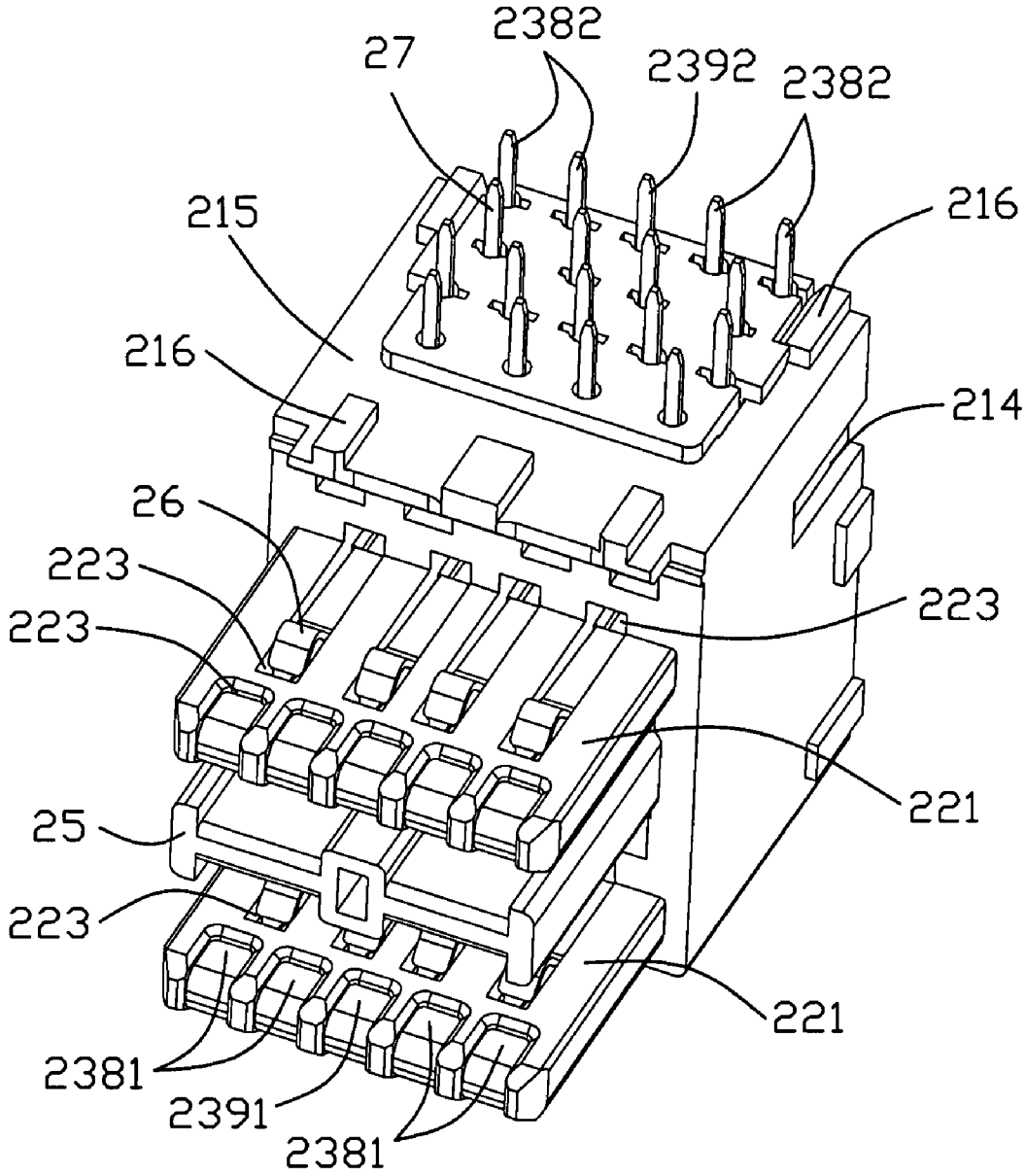
FIG. 9 is a perspective view of the extension to USB with a metal shell thereof removed therefrom.

As shown in FIGS. 7-9, an arrangement of the receptacle contacts 23 in the two single receptacle are same, so now taking the top receptacle for example. In the top receptacle, the receptacle contacts 23 include four receptacle conductive contacts designated with numeral 231, 232, 233 and 234 and a plurality of additional receptacle contacts 237 corresponding to the plug contacts 13. These receptacle contacts 23 are received in the receptacle contact receiving passageways 223 to be held in the supporting surface 221 of the receptacle tongue portion 22. The four receptacle conductive contacts 231, 232, 233 and 234 are inserted into corresponding passageways 223 from the rear end 212 of the receptacle base portion 21 while the additional receptacle contacts 237 are inserted into corresponding passageways 223 from the front end of the receptacle tongue portion 22.

As shown in FIGS. 7-9, the receptacle conductive contacts 231, 232, 233 and 234 are of the same configuration and each comprises a receptacle contact portion 26 and a tail portion 27. The receptacle contact portions 26 of the receptacle conductive contacts 231, 232, 233 and 234 are juxtaposed with each other along the front-to-rear direction when they are received in corresponding passageways 223. The receptacle contact portions 26 are cantileveredly accommodated in the corresponding passageways 223 and protrude downwardly beyond the supporting surface 221 so that the contact portion 26 is elastic and deformable when engaging with the plug conductive contacts 131, 132, 133 and 134 of the extension to USB plug 100. The tail portions 27 extend in a direction perpendicular to the bottom side 215 to be electrical mounted into corresponding through holes defined in the board (not shown) that the extension to USB receptacle 200 is mounted on. A spacer 230 with a plurality of through holes 2301 are disposed for the tail portions 27 extending therethrough so that the tail portions 27 can be parallel to each other. The tail portions 27 of the receptacle conductive contacts 231, 232, 233 and 234 are all in a semi-tube shape to increase strength thereof when mounted into corresponding through holes defined in the board.

As shown in FIGS. 7-9, the additional receptacle contacts 237 include two pairs of differential receptacle contacts 238 and a grounding receptacle contact 239. The two pairs of differential receptacle contacts 238 are used for transferring/receiving high-speed signals, and the grounding receptacle contact 239 is disposed between the two pairs of differential receptacle contacts 238 for preventing cross-talk. Each differential receptacle contact 238 of each pair comprises a flat and nonelastic contact portion 2381 supported by the supporting surface 221 and a tail portion 2382 perpendicular to the contact portion 2381. The grounding receptacle contact 239 comprises a flat and nonelastic grounding contact portion 2391 which is of the same configuration as the contact portion 2381 and a grounding tail portion 2392 located between the tail portions 2382 of each pair. When the differential receptacle contacts 237 are inserted into corresponding passageways 223, the contact portions 2381, 2391 are juxtaposed with each other along the front-to-rear direction. Meanwhile, the contact portions 2381, 2391 are located forward the receptacle contact portions 26 of the receptacle conductive contacts 231, 232, 233 and 234. Besides, each additional contact 237 comprises a bridge 251 and a connecting portion 252 connecting the contact portion 2381/2391 and the tail portion 2382/2392. The contact portion 2381, 2391 and the connecting portion 252 are parallel to each other wherein the contact portion 2381, 2391 is much shorter than the connecting portion 252.

Figure 14:
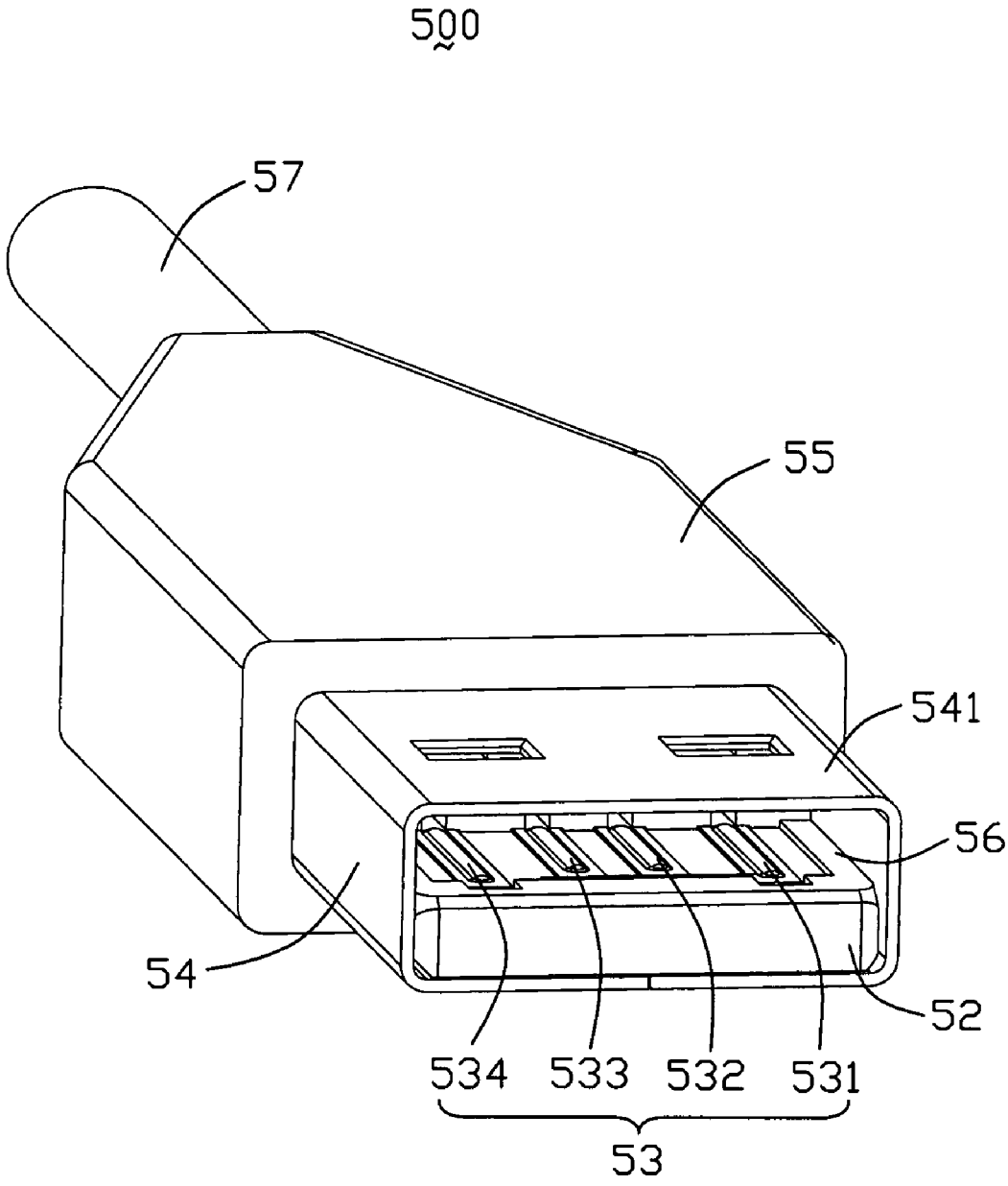
FIG. 14 (PRIOR ART)
FIG. 14 is a perspective schematic view of the standard USB plug connecting with a cable.

The extension to USB receptacle 200 is compatible to existing standard USB plug, such as the standard USB plug 500 shown in FIG. 14. The geometric profile of the receptacle tongue portion 22 is same to what of the standard USB receptacle 600 within an allowable tolerance, that is, length, width and height of the receptacle tongue portion 22 are substantially equal to what of the standard USB receptacle 600. An arrangement of the four receptacle conductive contacts 231, 232, 233 and 234 is compatible to what of the standard USB plug 500. The four receptacle conductive contacts 231, 232, 233 and 234 are for USB protocol to transmit USB signals. The conductive contacts 231, 232, 233 and 234 are adapted for power (VBUS) signal, – data signal, + data signal and grounding, respectively. So now, from assignment of each receptacle conductive contacts standpoint, different terminologies are given to each of the four receptacle conductive contacts 231, 232, 233 and 234. The conductive contacts 231, 232, 233 and 234 are respectively named as power contact 231, – data contact 232, + data contact 233 and ground contact 234.

Figure 6:
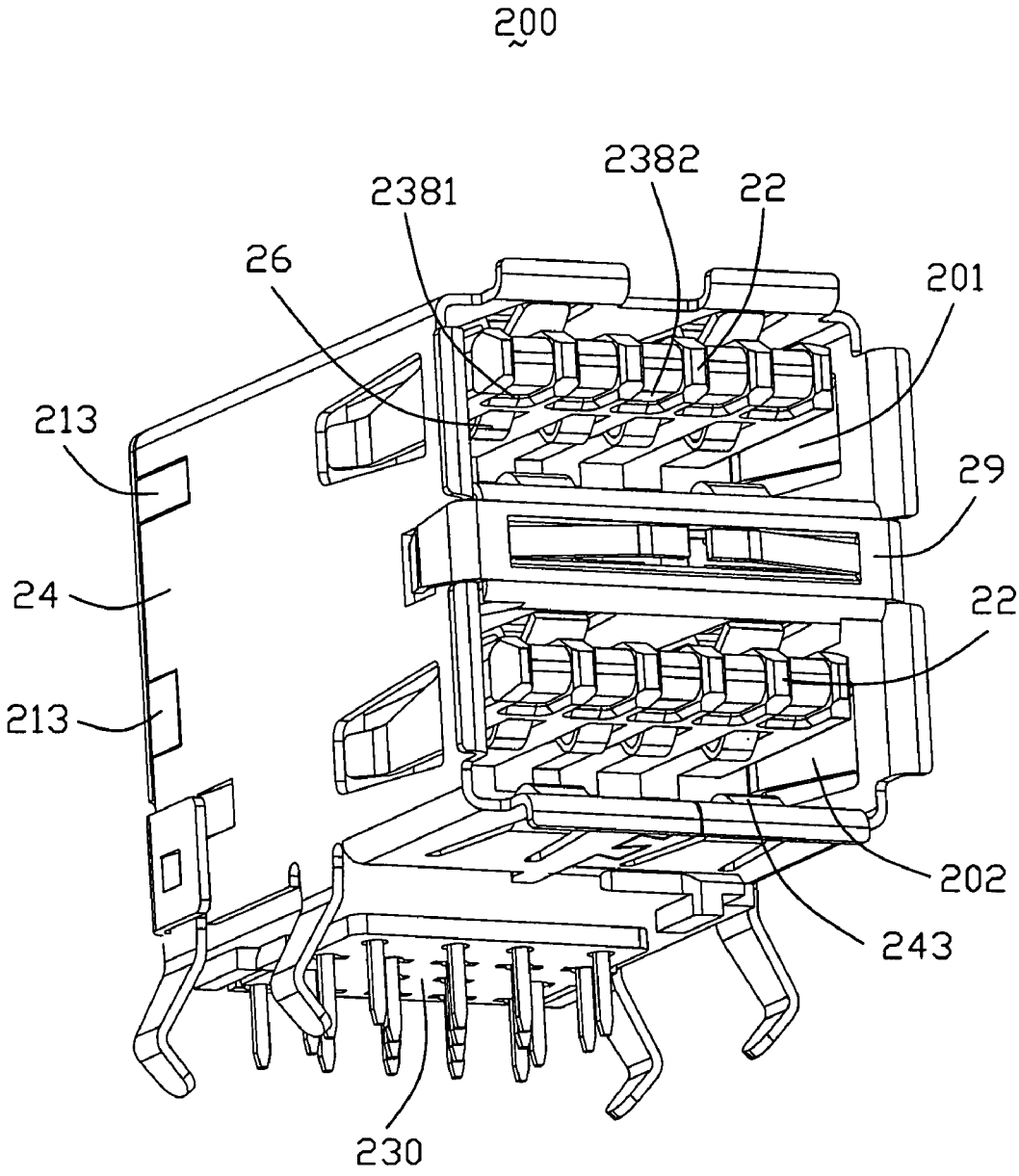
FIG. 6 is a perspective view of an extension to USB receptacle.

Regarding FIGS. 6-8, the receptacle metal shell 24 is in a tube shape, which defines a top face 242, a bottom face 241 opposite to the top face 242 and a pair of sidewalls 249 connecting the top face 242 and the bottom face 241. The receptacle metal shell 24 is secured to the receptacle base portion 21 to enclose the receptacle tongue portion 22 and the receptacle contacts 23 with a receiving cavity 202 formed between the supporting surface 221 of the below receptacle and the bottom face 241. Each of the top and bottom sides 242, 241 and the pair of sidewalls 249 is formed with a pair of spring arms 243, 246. The top face 242 also forms a tab 248 projecting inwardly to engage with the receptacle base portion 21 and a pair of through holes 247 near a rear end thereof. The pair of sidewalls 249 define a plurality of depressed portions 2491 near the rear end thereof and a plurality of projections 244 protruding inwardly to engage with corresponding projections 213 and depressed portions 214 of the receptacle base portion 21, respectively. Thus, the receptacle metal shell 24 is secured on the receptacle base portion 21 firmly.

The another metal shell 29 includes a front wall 290, a pair of sidewall 292 extending rearward from right and left edges of the front wall 290, and a pair of top and bottom walls 294 extending rearwardly from top and bottom edges of the front wall 290. The front wall 292 forms a pair of spring arms 291 stamped outwardly therefrom. Each of the top and bottom walls 294 forms a pair of sparing arms 293 stamped upwardly therefrom and a pair of engaging portions 295 for being pressed into the receptacle base portion 21. The another metal shell 29 is mounted to the supporting plate 25 from a front side of the receptacle housing 20. A top receiving cavity 201 of the top receptacle is formed between the supporting surface 221 of the top receptacle and the top wall 294 of the another metal shell 29. The elastic contact portions 26 and nonelastic contact portions 2371 are all exposed to the receiving cavities 201, 202 for mating with corresponding contact portions of a complementary connector. An arrangement of the receiving cavities 201,202 and the receptacle tongue portion 22 are also compatible with what of standard USB plug 500.

The rear metal shell 28 comprises a body 281 and a pair of holding arms 282 extending from an upper edge of the body 281. The holding arms 282 are received in the through holes 247 of the receptacle metal shell 24 so that the rear metal shell 28 can be combined with the receptacle metal shell 24.

As fully described above, the extension to USB plug 100 and the extension to USB receptacle 200 both are compatible to the standard USB connector. In application, the extension to USB plug 100 is capable of mating with the standard USB receptacle 600 or the extension to USB receptacle 200. The extension to USB receptacle 200 is capable of mating with the standard USB receptacle 600 or the extension to USB receptacle 200 as well.

Figure 10:
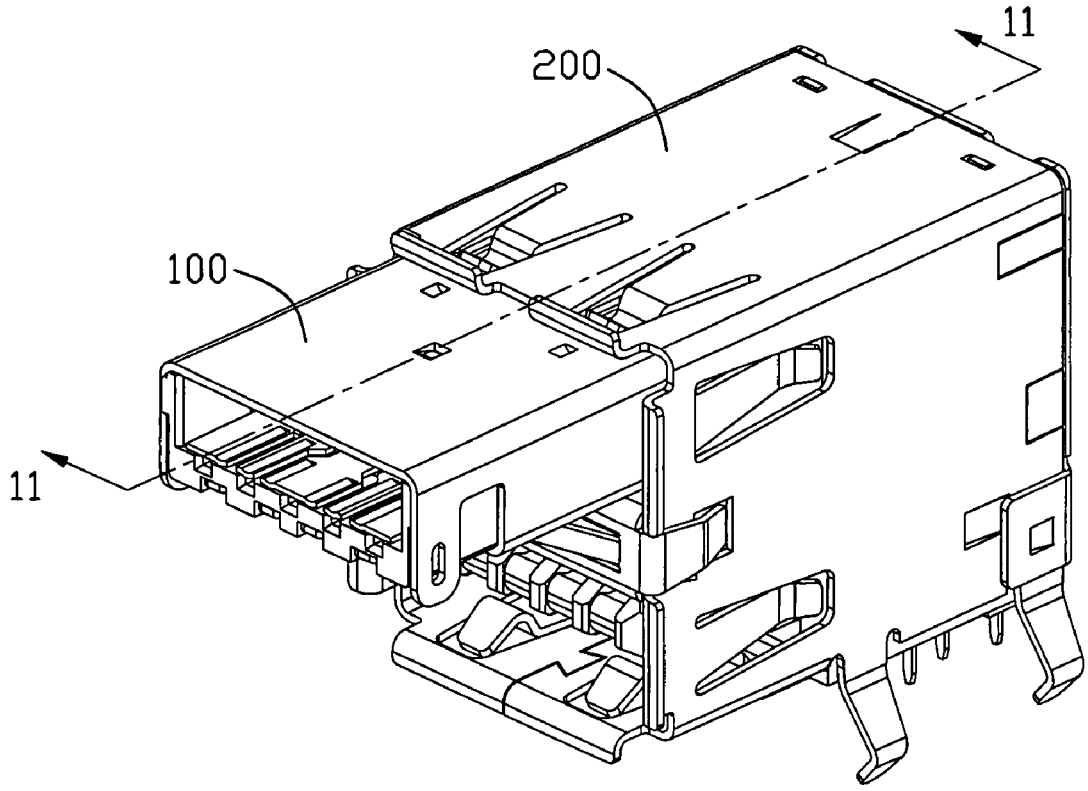
FIG. 10 is a perspective view of the extension to USB plug and receptacle, showing a state that the extension to USB plug is fully inserted into the extension to USB receptacle.
Figure 11:
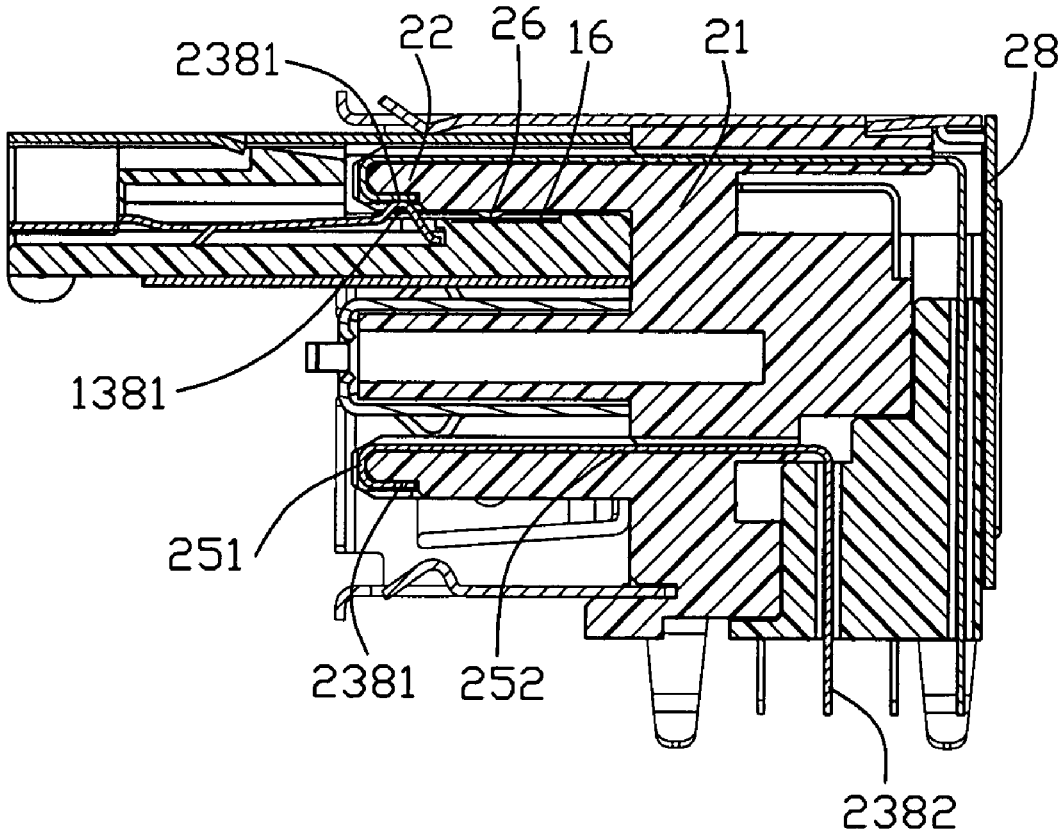
FIG. 11 is a cross-sectional view of the extension to USB plug and receptacle taken along line 11-11 of FIG. 10, showing additional contacts of the extension to USB receptacle contacting corresponding additional contacts of the extension to USB plug.
Figure 12:
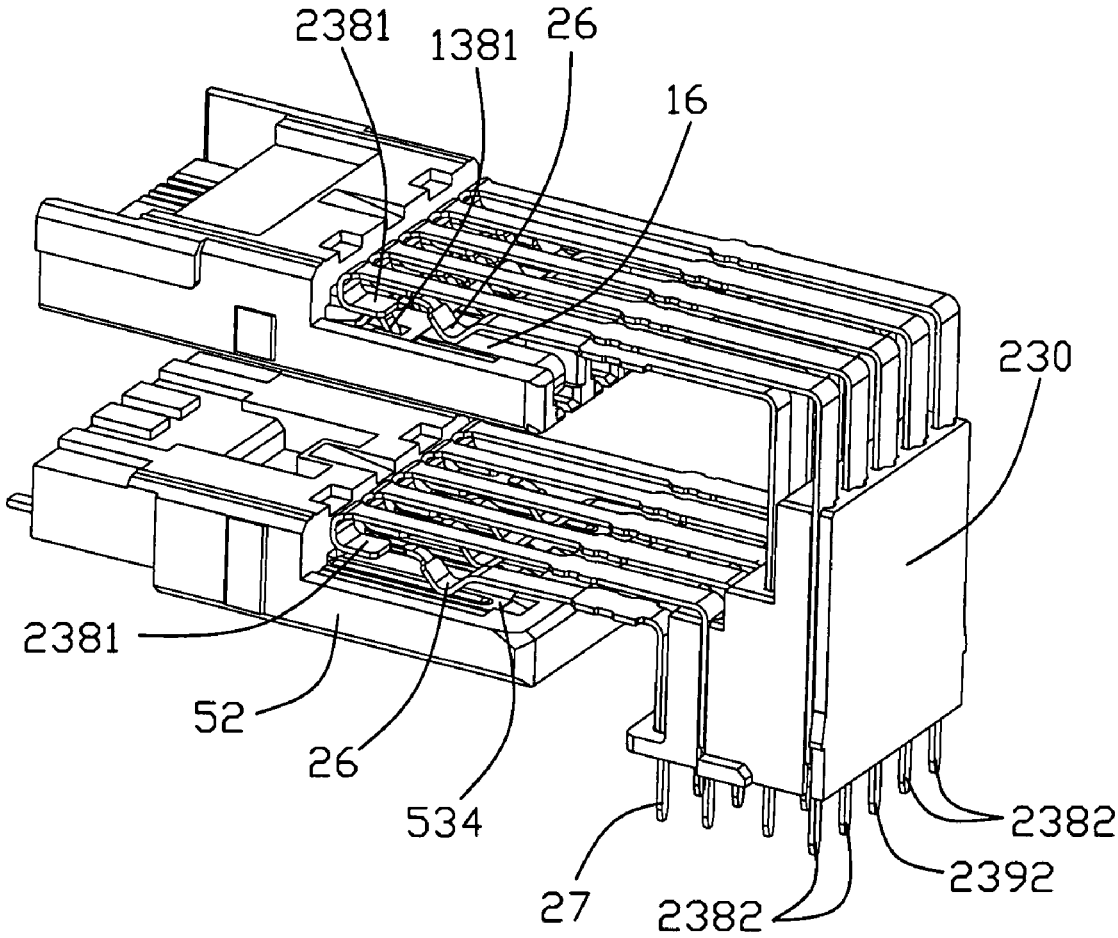
FIG. 12 is a perspective view of the extension to USB plug and a standard USB plug inserted into the extension to USB receptacle with their metal shells taken off, illustrating mating relations of the contacts of the extension to USB plug and receptacle as well as mating relations of the contacts of the standard USB plug and the extension to USB receptacle.

In FIGS. 10-12, a mating status of the extension to USB plug 100 fully insertion into the extension to USB receptacle 200 is shown. After the extension to USB plug 100 is fully inserted into the extension to USB receptacle 200, all plug contacts 13 physically contact corresponding receptacle contacts 23 as clearly shown in FIGS. 12-13. In this case, the connector assembly transmits non-USB signals under the non-USB protocol. Meanwhile, the spring arms 243 of the receptacle metal shell 24 engage with corresponding through holes 143 of the plug shell 14 and other spring arms 246 of the receptacle metal shell 24 engage with sidewalls 146 of the plug shell 14 to secure the mating state and shielding effect of the metal shells 14 and 24. Under the non-USB protocol, the two pairs of differential plug/receptacle contacts 138, 238 transfer differential signals unidirectionally, one pair for receiving data and the other for transmission data.

Regarding FIG. 12, a mating status of the standard USB plug 500 which is located below the extension to USB plug 100 and fully inserted into the extension to USB receptacle 200 is shown. To clarify relationships of their contacts, their metal shells 54 and 24 are taken off. After the standard USB plug 500 is fully inserted into the extension to USB receptacle 200, all contacts 53 physically contact corresponding receptacle contacts 231, 232, 233 and 234 to transmit USB signals under USB protocol. The differential receptacle contacts 237 of the extension to USB receptacle 200 make no electrical connection with any part of the standard USB plug 500.

Figure 13:
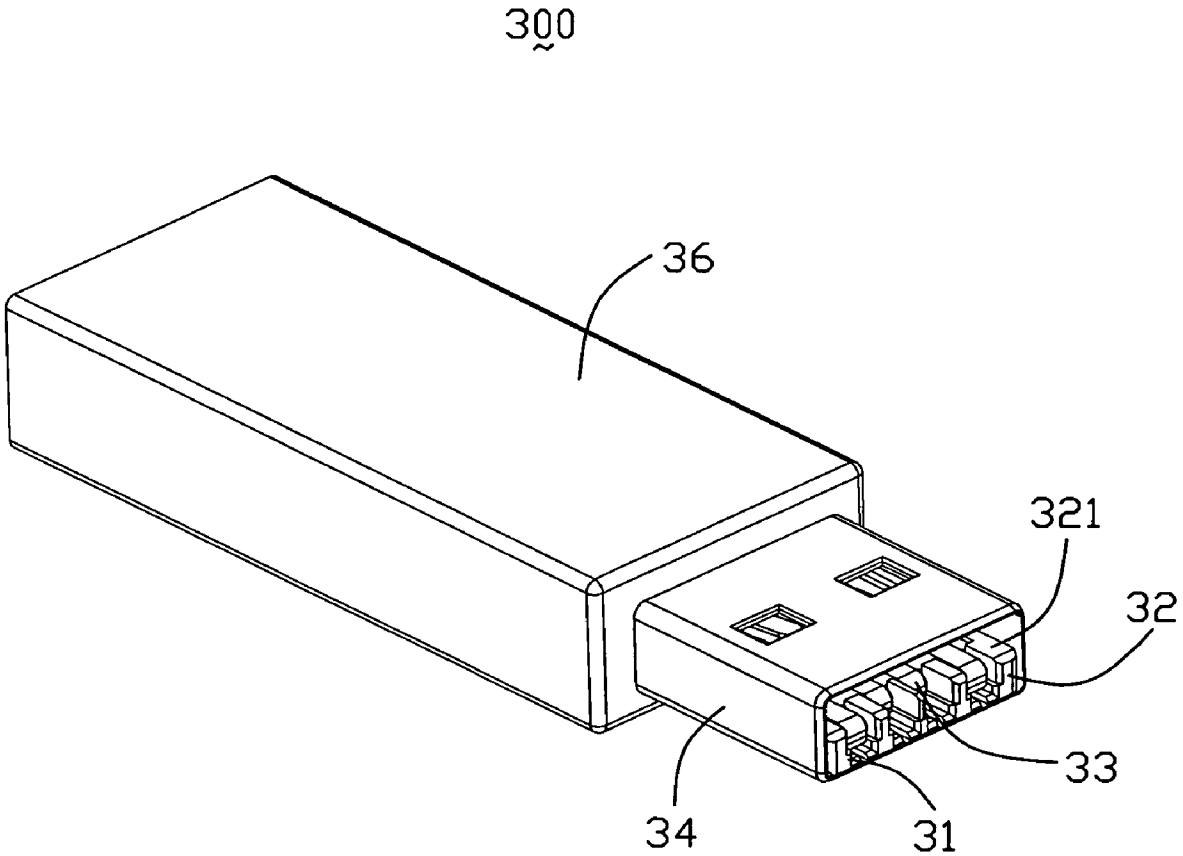
FIG. 13 is a perspective view of an extension to USB plug according to a second embodiment of present invention.

A second embodiment of the present invention is disclosed in FIG. 13. In this embodiment, the extension to USB is a memory device 300. The memory device 300 includes an outer case 36 enclosing a printed circuited board with a memory unit (not shown) and an interface 31 electrically connecting with the printed circuit board. The interface 31 includes a tongue portion 32, a plurality of contacts 33 supported on a supporting surface 321 of the tongue portion 32. The tongue portion 32 and the contacts 33 are both with an arrangement same to what of the extension to USB plug 100 shown in FIG. 1, which is compatible to what of the standard USB connector. Therefore, detailed description about the tongue portion 32 and the contacts 33 are omitted here. In this embodiment, tail portions (not shown in FIG. 13, but can referred to FIG. 3) of the contacts 33 are physically and electrically connected to the printed circuit board. In addition, in this embodiment, a metal shell 34 is provided to enclose the tongue portion 32 and the contacts 33. An arrangement between the metal shell 34 and the tongue portion 32 is also same to what of the extension to USB plug 100. The memory device 300 is capable of mating with either of the standard USB receptacle 600 or the extension to USB receptacle 200 shown in FIG. 6.

With contrast to the standard USB connector (standard USB plug and standard USB receptacle), the additional two pairs of differential contacts 138, 238 in the extension to USB plug 100 and the extension to USB receptacle 200 provide a high transfer data for an electrical connector system with the extension to the extension to USB plug 100 and the extension to USB receptacle 200 in operation. Take the extension to USB plug 100 for example, the arrangement of power contact 131, the – data contact 132, the + data contact 133 and the ground contact 134 is compatible to what of a standard USB receptacle. This means that the extension to USB plug 100 can be applied in any field that the standard USB plug is applied. The pair of differential plug contacts 137 are located behind the plug conductive contacts 131, 132, 133 and 134. With such arrangement, the extension to USB plug 100 is with an ease structure and is portable. Furthermore, as the two pairs of differential plug contacts 137 are used for a non-USB protocol, now, the extension to USB plug also can applied in other electronic device supporting the non-USB protocol.

In the first and second embodiments, the number of the additional plug contacts 137 is five which consists of two pairs of differential plug contacts 138 and a grounding plug contact 139 disposed between each pair of the differential plug contacts 138 as best shown in FIGS. 2 and 3. However, in other embodiments, the additional plug contacts 137 can only comprise a pair of differential plug contacts for transmitting/receiving high-speed signals, and if necessarily, a grounding contact can be provided to be positioned on each lateral side of the pair of differential plug contacts. Accordantly, the additional receptacle contacts 237 can only comprise a pair of differential receptacle contacts for transmitting/receiving high-speed signals corresponding to the pair of differential plug contacts of the extension to USB plug. If necessarily, another grounding contact can be positioned on each lateral side of the pair of differential receptacle contacts for mating with the grounding contact of the extension to USB plug.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical plug compatible to version 2.0 Universal Serial Bus (USB) standard, comprising:

an insulative housing defining an elevated rear portion and a mating portion extending forwardly from the rear portion, the mating portion having a mating surface divided into a first mating section and a second mating section along a rear-to-front direction;

a plurality of first passageways extending from the rear portion to the first mating section and in communicating to the mating surface;

a depression defined in the second mating section;

a first set of contacts received in the first passageways, and each having an elastic contact portion movably extending beyond the mating surface; and a second set of contacts each having a stiff contact portion securely retained in the depression; wherein the stiff contact portion and the elastic contact portion are located on a same side of the mating portion in condition that the elastic contact portion is located behind the stiff contact portion along the rear-to-front direction; wherein the second set of contacts are USB contacts; wherein a dimension of the mating portion is defined according version 2.0 USB standard; wherein a length of the mating portion is substantially the same as that of a standard version 2.0 type-A USB plug, wherein the stiff contact portion is flat shaped and substantially coplanar with the mating surface of the insulative housing, and wherein the depression is recessed from the mating surface and doesn't extend through the mating portion along a vertical direction perpendicular to the rear-to-front direction, wherein the second set of contacts each comprises a second tail portion parallel to and longer than the stiff contact portion, the second tail portion and the stiff contact portion being located on different horizontal planes, and wherein the second tail portion is located below the stiff contact portion; wherein the second mating section defines a plurality of second passageways under the depression, the second passageways extending backwardly through the rear portion of the insulative housing, and wherein the first set of contacts are assembled to the first passageways along the rear-to-front direction, and the second tail portions are received in the second passageways along a front-to-rear direction, wherein the mating portion includes a front distal end with the second passageways recessed backwardly from the front distal end, wherein the first set of contacts each includes a first tail portion extending backwardly from the elastic contact portion, the fist tail portion being located over the second tail portion while the first tail portion being located essentially coplanar with the stiff contact portion.

2. The electrical plug as claimed in claim 1, further comprising a metal shell enclosing the mating portion to form a receiving cavity therebetween, the elastic contact portion extending into the receiving cavity and the stiff contact portion exposed to the receiving cavity.

3. The electrical plug as claimed in claim 1, further comprising a case for gripping by a user and a printed circuit board, enclosed by the case, the printed circuit board comprising a memory unit electrically connecting with the first and the second set of contacts.

4. The electrical plug as claimed in claim 1, wherein the stiff contact portion occupies a majority of length of the mating portion along the rear-to-front direction with respect to that of the elastic contact portion.

5. The electrical plug as claimed in claim 1, wherein the second contacts are disposed side by side along a transverse direction perpendicular to the rear-to-front direction and comprises two pairs of differential contacts and a grounding contact located between each pair of the differential contacts.

6. The electrical plug as claimed in claim 1, wherein the first set of contacts each includes a first tail portion extending backwardly from the elastic contact portion, the first tail portion including a rear distal end, the portion of the insulative housing defining a rear cavity extending upwardly through the rear portion with the rear distal end exposed to the rear cavity.

7. A shielded electrical receptacle, comprising:

an insulative housing including a base and a tongue portion protruding from the base, the tongue portion having a mating surface defined with a plurality of recessed areas adjacent to a tip of the tongue portion;

a metallic shell shielding the tongue portion and jointly defined a receiving space for receiving another connector;

a plurality of conductive contacts each comprising an elastic contact portion extending beyond the mating surface and protruding into the receiving space; and a plurality of additional contacts each comprising a nonelastic contact portion located forward the elastic contact portion along a rear-to-front direction, the elastic and the nonelastic contact portions being located on a same side of the tongue portion; wherein the nonelastic contact portions are received in the recessed areas and are exposed to the receiving space; wherein the plurality of conductive contacts are USB contacts; wherein a length of the tongue portion is substantially the same as that of a standard version 2.0 type-A USB receptacle, wherein the shielded electrical receptacle is compatible to version 2.0 Universal Serial Bus (USB) standard, wherein each nonelastic contact portion is flat and comprises an out surface lower than the mating surface of the tongue portion under a condition when the elastic contact portions upwardly protrude into the receiving space, wherein the tongue portion comprises a plurality of raised portions in condition that at least one of the nonelastic contact portions is located between the adjacent two raised portions, wherein each of the recessed areas is formed between the adjacent two raised portions with the nonelastic contact portions received therein, wherein an user surface of each of the raised portions is coplanar with the mating surface of the tongue portion, wherein the tongue portion is divided into a first mating portion and a second mating portion, a plurality of first passageways being defined in the base and further extending to the first mating portion to receive the elastic contact portions, and wherein the plurality of recessed areas are defined in the second mating portion and are spaced away from the first passageways, wherein the elastic contact portions are moveable in the first passageways, and the recessed areas extend forwardly through the tip of the tongue portion, wherein each additional contact comprises a connecting portion and a bridge connecting the nonelastic contact portion and the connecting portion, the connecting portion being parallel to the nonelastic contact portion and being located over the nonelastic contact portion, and wherein the bridge is perpendicular to the non-elastic contact portion.

8. The shielded electrical receptacle as claimed in claim 7, wherein each additional contact comprises a tail portion extending downwardly from the connecting portion, the tail portion being perpendicular to the nonelastic contact portion.

* * * * *